United States Patent [19]

Wilmeth et al.

[11] Patent Number: 5,009,000

[45] Date of Patent: Apr. 23, 1991

[54] METHOD FOR MAKING SUCKER ROD OIL WELL PUMP

[75] Inventors: Thomas S. Wilmeth, Daingerfield; Steven L. Wilmeth, Longview; Francis E. Foster, Daingerfield, all of Tex.

[73] Assignee: Scot Industries, Inc., Lone Star, Tex.

[21] Appl. No.: 383,019

[22] Filed: Jul. 19, 1989

Related U.S. Application Data

[62] Division of Ser. No. 167,911, Sep. 28, 1988, abandoned.

[51] Int. Cl.[5] ..... C21D 1/10

[52] U.S. Cl. ..... 29/888.02; 29/888; 29/527.1; 92/162 R; 148/150; 148/152; 417/545; 417/554

[58] Field of Search ..... 29/156.4 R, 527.1, 888.02, 29/888; 417/545, 554, DIG. 1; 148/16, 150; 92/162 R

[56] References Cited

U.S. PATENT DOCUMENTS

| | | | |
|---|---|---|---|
| 2,443,312 | 6/1948 | Geiger et al. | 29/156.4 R |
| 3,222,228 | 12/1965 | Stanley et al. | 148/16 |
| 3,489,620 | 1/1970 | Current | 148/150 |
| 3,910,730 | 10/1975 | Gage | 417/554 |
| 4,486,249 | 12/1984 | Woodings | 148/150 |
| 4,599,502 | 7/1986 | Khare et al. . | |
| 4,692,305 | 9/1987 | Rangaswamy et al. . | |
| 4,725,508 | 2/1988 | Rangaswamy et al. | 428/570 |
| 4,741,254 | 5/1988 | Taylor | 29/156.4 R |

FOREIGN PATENT DOCUMENTS

| | | | |
|---|---|---|---|
| 572796 | 10/1945 | United Kingdom | 148/16 |

OTHER PUBLICATIONS

"Everything You've Always Wanted to Know About Boronizing but were Too Busy to Ask", Andrew Linial.

*Primary Examiner*—Irene Cuda

*Attorney, Agent, or Firm*—James E. Bradley

[57] ABSTRACT

A method of hardening a sucker rod well pump has a step of forming a boronized case on the plunger. Then the plunger is heated and quenched to form a hardened steel supporting layer. A chromium case is formed on the barrel.

7 Claims, 1 Drawing Sheet

METHOD FOR MAKING SUCKER ROD OIL WELL PUMP

This application is a division of application Ser. No. 167,911, filed Sept. 28, 1988, now abandoned.

BACKGROUND OF THE INVENTION

1. Field of the Invention

This invention relates in general to sucker rod oil well pumps and in particular to hardened metal layers on the plunger and barrel.

2. Description of the Prior Art

Sucker rod well pumps have been in wide use for many years. A barrel is mounted to the tubing. The barrel has a smooth cylindrical bore. A plunger is positioned inside the tubing and connected to the sucker rod. The sucker rod is reciprocated up and down to move the plunger in the barrel. A stationary check valve is located at the bottom of the barrel. A traveling valve is located at the bottom of the plunger. The valves cooperate on the downstroke and upstroke to pump fluid from the well to the surface.

The mating surfaces between the plunger and barrel provide a very close fit. In wells which produce abrasive particles, such as quartz or sand, these particles can quickly damage the mating surfaces. The wear due to the abrasive particles will cause leakage past the plunger. This necessitates the pump being pulled for replacement at fairly frequent intervals.

Various techniques have been used in the past to increase the wear resistance. In one technique, a chrome case is plated on either of the barrel or the plunger. Circumferential grooves have also been formed in the plunger.

It is an object of this invention to provide a method for making a sucker rod well pump with increased wear resistance to abrasive particles.

It is the further object of this invention to provide a method for hardening the walls of a well pump plunger and a barrel.

It is the further object of this invention to provide a method of hardening a wall of a steel plunger for a well pump by applying a boronized case supported by a hardened steel layer.

SUMMARY OF THE INVENTION

In this invention, the barrel is chrome plated. The chromium case is preferably about twice the thickness of that used in the past.

The plunger is preferably formed with a plurality of circumferential grooves spaced apart from each other. A boronized layer or case is formed on the cylindrical wall of the plunger. The case under the boronized layer is hardend by induction hardening and supports the harder boronized case. The boronized case engages the chromium case in sliding contact. Both surfaces have a hardness that is greater than that expected of the abrasive particles in the well fluid.

DESCRIPTION OF THE PREFERRED EMBODIMENT

Figure 1:
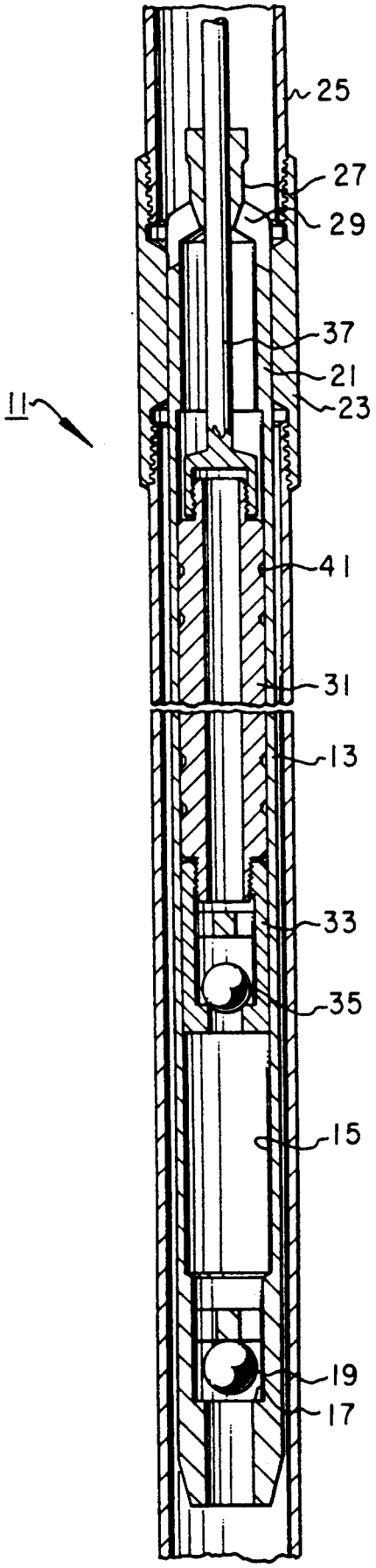
FIG. 1 is a vertical sectional view illustrating a sucker rod oil well pump constructed in accordance with this invention, with some of the portions being schematically shown.

Referring to FIG. 1, pump 11 includes a barrel 13. Barrel 13 is a thin walled tubular member. It has a cylindrical bore 15. Normally, the barrel 13 is formed of steel. A chromium case is plated on the bore 15. The chromium case is plated in a conventional manner, except that it is about twice the thickness of the chromium cases placed in conventional barrels of sucker rod pumps. Preferably, the layer is from 0.006 to 0.008 thickness on each side. This results in a hardness at the surface of approximately 68 to 70 Rockwell "C". This hardness is greater than the hardness of the typical abrasive particles, such as quartz, found in oil wells.

A standing valve 17 is located on the bottom of the barrel 13. A ball 19 is part of standing valve 17. A hold down 21 is located on the upper end of barrel 13 in the embodiment shown. The hold down 21 is not shown in detail, however, it has latches and seals for sealing releasably in a seating nipple 23. The seating nipple 23 is connected into the string of tubing 25. Barrel 13 is thus located within the string of tubing 25. A cage 27 is located on the upper end of the hold down 21. Cage 27 has ports 29 to allow well fluid to flow into the tubing 25 and to the surface.

A plunger 31 is reciprocally carried inside the barrel 13. The clearance between the plunger 31 and the bore 15 is very small. Plunger 31 is a tubular steel member. It has a traveling valve 33 located on the lower end. Traveling valve 33 includes a ball 35. The upper end of plunger 31 is connected to the lower end of a string of sucker rod 37 that extends to the surface. Sucker rod 37 passes through the cage 27.

Figure 2:
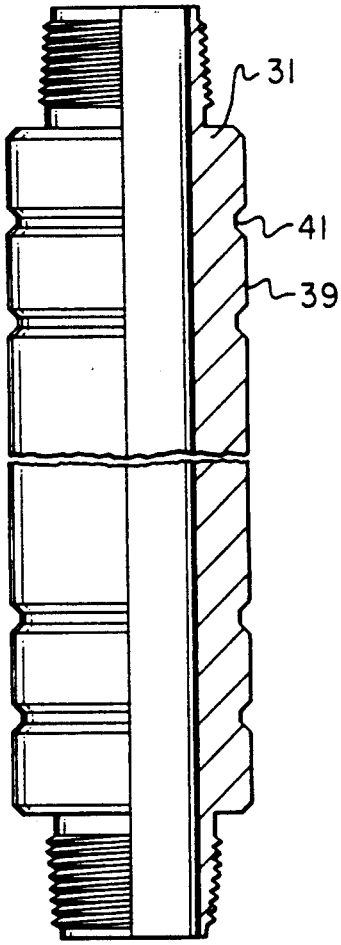
FIG. 2 is a partially sectioned, enlarged view of a plunger for the well pump of FIG. 1.

Referring to FIG. 2, the plunger 31 has cylindrical wall 39. A plurality of parallel circumferential grooves 41 are formed in the wall. Grooves 41 are not shown to scale in FIG. 2. Preferably, each groove 41 is about ⅛ inch in vertical dimension and ⅛ inch deep. Preferably there are two grooves 41 near the top of plunger 31 and two near the bottom of plunger 31. The grooves 41 in each pair are preferably about ¾ inch apart. There may be other grooves 41 along the length of the plunger 31 between the pairs at the top and the bottom. Each of these other grooves 41 are preferably about six to eight inches apart from each other.

After the grooves 41 are formed, and before any hardening, a boronized case is formed on the cylindrical wall 39. The boronized case is formed in a conventional manner by fluidized bed techniques. In this technique, as is known in the prior art, the plunger 31 will be heated to above 1800 degrees F. for about four hours while immersed in a fluidized bed containing boronizing powder. This produces a boronized case that is about 0.003 to 0.0010 inch in thickness. The boronized case may be formed by other methods including packing the plunger in boronizing powder, by liquid boronizing or other known techniques.

Then, the plunger 31 is hardened to harden the steel supporting layer beneath the boronized case. The preferred technique is by using induction hardening, which is a known process. In induction hardening, the plunger 31 is passed through a coil (not shown). The coil has high frequency alternating current passing through it. This heats a surface layer of the plunger 31. The rate at which the plunger 31 passes through the induction coil, and the power supplied to the induction coil, are controlled so that the temperature in a surface layer of the cylindrical wall 39 will be above 1800 degrees F. This layer extends about 0.030–0.050 inch deep measured from the exterior of the cylindrical wall 39 and supports the boronized case.

A quenching ring (not shown) is located on the induction hardening apparatus immediately behind the coil. The quenching ring discharges water onto the plunger 31 to quench the heated layer and harden it. This results in a hardened layer of steel supporting the boronized case. The hardened layer is about 0.030–0.050 inch deep.

The hardness of the hardened steel layer beneath the boronized case will be about 55 to 60 Rockwell "C". The hardness at the surface of the boron case will be over 80 Rockwell "C" and is typically measured on the Knoop scale. On the Knoop scale, the hardness of the boron case will be 1500–1650, while the hardness of the chromium case in the barrel 13 will be about 950 KNOOP.

In operation, the pump 11 will be placed in the tubing 25 and secured by the hold down 21 in the seating nipple 23. A pump jack (not shown) at the surface will reciprocate the rod 37 and the plunger 31. As the plunger 31 moves downward, well fluid contained in the barrel 13 will flow past the ball 35 into the interior of the plunger 31. On the downstroke, the ball 19 will seat on the seat 17. On the upstroke, the well fluid contained inside the plunger 31 will be pushed upward through the ports 29 into the tubing 25. Suction created by the upward movement of the plunger 31 lifts the ball 19. This allows well fluid in the tubing 25 below the barrel 13 to be drawn into the barrel 13.

Abrasive particles will tend to be trapped in the grooves 41. The grooves 41 also help equalized hydrostatic pressure around the plunger 31. The boron case on the plunger 31 and the chromium case on the barrel 13 are both harder than most abrasive particles expected to be found in the well.

The invention has significant advantages. Since both the boronized case and chromium case are harder than the particles found in the well, wear resistance is greatly improved.

While the invention has been shown in only one of its forms, it should be apparent to those skilled in the art that it is not so limited, but is susceptible to various changes without departing from the scope of the invention.

We claim:

1. A method of constructing portions of a sucker rod pump for a well, comprising in combination:

providing a steel plunger with an exterior cylindrical wall;

forming a plurality of spaced apart circumferential grooves in the exterior cylindrical wall; then forming a boronized case on the exterior cylindrical wall; then passing the plunger through an induction heater coil to heat a selected depth of the exterior cylindrical wall for hardening; and immediately quenching the exterior cylindrical wall by spraying with a liquid to harden a layer of the steel below the boronized case for supporting the boronized case;

providing a barrel with a cylindrical bore; and forming a chromium case on the bore to a selected depth for receiving the plunger in sliding contact.

2. The method according to claim 1 wherein the induction heater coil heats the selected depth of the cylindrical wall to a temperature above 1800 degrees F.

3. The method according to claim 1 wherein the layer of steel below the boronized case is hardened to a depth in the range from 0.030 inch to 0.050 inch measured from the exterior of the cylindrical wall.

4. The method according to claim 1 wherein the chromium case is formed to a depth of at least 0.0060 inch.

5. The method according to claim 1 wherein the boronized case is formed to a depth of at least 0.003 inch.

6. A method of constructing portions of a sucker rod pump for a well, comprising in combination:

providing a steel plunger with an exterior cylindrical wall;

forming a boronized case on the exterior clyindrical wall; then heating the plunger for a selected duration to heat a selectd depth of the exterior cylindrical wall for hardening; then immediately quenching the exterior cylindrical wall by spraying with a liquid to harden a layer of the steel below the boronized case for supporting the boronized case;

providing a barrel with a cylindrical bore; and forming a hardened case on the bore to a selected depth for receiving the plunger in sliding contact.

7. A method of constructing portions of a sucker rod pump for a well, comprising in combination:

providing a steel plunger with an exterior cylindrical wall;

forming a plurality of spaced apart circumferential grooves in the exterior cylindrical wall; then forming a boronized case on the exterior cylindrical wall; then passing the plunger through an induction heater coil to heat a selected depth of the exterior cylindrical wall for hardening; then immediately quenching the exterior cylindrical wall by spraying with a liquid to harden a layer of the steel below the boronized case for supporting the boronzied case;

providng a barrel with a cylindrical bore; and forming a hardened case on the bore to a selected depth for receiving the plunger in sliding contact.

* * * * *